US009759527B2

(12) United States Patent
Davis

(10) Patent No.: US 9,759,527 B2
(45) Date of Patent: Sep. 12, 2017

(54) SCOPE MOUNTING APPARATUS AND SHIELD

(71) Applicant: Don Davis, Lebanon, OH (US)

(72) Inventor: Don Davis, Lebanon, OH (US)

( * ) Notice: Subject to any disclaimer, the term of this patent is extended or adjusted under 35 U.S.C. 154(b) by 0 days.

(21) Appl. No.: 15/156,455

(22) Filed: May 17, 2016

(65) Prior Publication Data

US 2016/0341522 A1 Nov. 24, 2016

Related U.S. Application Data

(60) Provisional application No. 62/163,049, filed on May 18, 2015.

(51) Int. Cl.
*F41H 5/12* (2006.01)
*F41G 11/00* (2006.01)

(52) U.S. Cl.
CPC ..... *F41H 5/12* (2013.01); *F41G 11/003* (2013.01)

(58) Field of Classification Search
CPC ..... F41H 5/12; F41G 11/001–11/005
USPC ..... 42/124
See application file for complete search history.

(56) References Cited

U.S. PATENT DOCUMENTS 1,244,679 A * 10/1917 Winn, Jr. ..... F41H 5/12 89/36.06
1,320,888 A * 11/1919 Miller ..... F41H 5/12 42/106
2,599,689 A * 6/1952 Brelsford ..... F41A 35/02 359/511
3,208,146 A * 9/1965 Nelson ..... F41A 35/02 359/511
3,977,113 A * 8/1976 Howell ..... F41G 1/383 42/129
5,155,915 A * 10/1992 Repa ..... F41G 1/383 42/127
5,183,953 A * 2/1993 Anderson ..... F41G 1/383 150/154
6,725,594 B2 * 4/2004 Hines ..... F41A 35/02 42/124
7,404,352 B1 * 7/2008 Hoffman ..... F41H 5/12 2/2.5
D673,239 S * 12/2012 Cheng ..... D22/109
8,499,484 B2 * 8/2013 Schneider ..... F41G 11/003 340/505
8,511,215 B1 * 8/2013 Tervola ..... F41H 5/08 89/36.03
9,587,907 B2 3/2017 Baker et al.
2010/0236124 A1 * 9/2010 Troy ..... F41A 35/02 42/90
2011/0247255 A1 * 10/2011 Ding ..... F41G 11/003 42/90
2012/0174462 A1 * 7/2012 Spuhr ..... F41G 1/387 42/124
2013/0283663 A1 * 10/2013 Joplin ..... F41G 11/003 42/124

(Continued)

*Primary Examiner* — Joshua Freeman
(74) *Attorney, Agent, or Firm* — Taft Stettinius & Hollister LLP; Derek Lavender

(57) ABSTRACT

A mounting assembly for mounting an optic to a body having a bottom member defining a mounting base, a top member releasably coupled to the bottom member to define an optic aperture therebetween, and a protective shield coupled to the top member. The protective shield is coupled directly to the top member and the top member is coupled to the body through the bottom member.

19 Claims, 3 Drawing Sheets

(56) References Cited

U.S. PATENT DOCUMENTS

| | | | | |
|---|---|---|---|---|
| 2014/0190062 | A1* | 7/2014 | Turner, Jr. | F41G 11/003 42/124 |
| 2014/0259854 | A1* | 9/2014 | Williams | F41G 1/387 42/124 |

* cited by examiner

SCOPE MOUNTING APPARATUS AND SHIELD

RELATED APPLICATIONS

The present application claims the priority of U.S. Provisional Application No. 62/163,049, filed May 18, 2015, the disclosure of which is hereby incorporated by reference in its entirety.

TECHNICAL FIELD

The present teachings are related to a scope mounting apparatus, and more particularly to a scope mounting apparatus containing a protective shield.

SUMMARY

One embodiment is a mounting assembly for mounting an optic to a body, having a bottom member defining a mounting base, a top member releasably coupled to the bottom member to define an optic aperture therebetween and a protective shield coupled to the top member. The protective shield is coupled directly to the top member and the top member is coupled to the body through the bottom member.

Another embodiment is an optic mounting system for mounting an optic to a body, having a first scope ring with a first bottom member defining a first mounting base, a first top member releasably coupled to the first bottom member to define a first optic aperture therebetween, a second scope ring including a second bottom member defining a second mounting base, a second top member releasably coupled to the second bottom member to define a second optic aperture therebetween, and a protective shield coupled to the first top member and the second top member. The protective shield substantially aligns the first optic aperture with the second optic aperture when the protective shield is coupled to the first and second top members.

A method for manufacturing a scope mounting assembly that includes forming a bottom member from a material, the bottom member defining a mounting base and a portion of an aperture, forming a top member from a material, the top member defining a portion of the aperture, boring a threaded section into the top member, and forming a protective shield from a material and boring a shield through hole through the protective shield. The shield through hole and the threaded section are sized to receive a fastener that couples the protective shield to the top member.

DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The above-mentioned aspects of the present application and the manner of obtaining them will become more apparent and the teachings of the present application itself will be better understood by reference to the following description of the embodiments of the present application taken in conjunction with the accompanying drawings.

Figure 1:
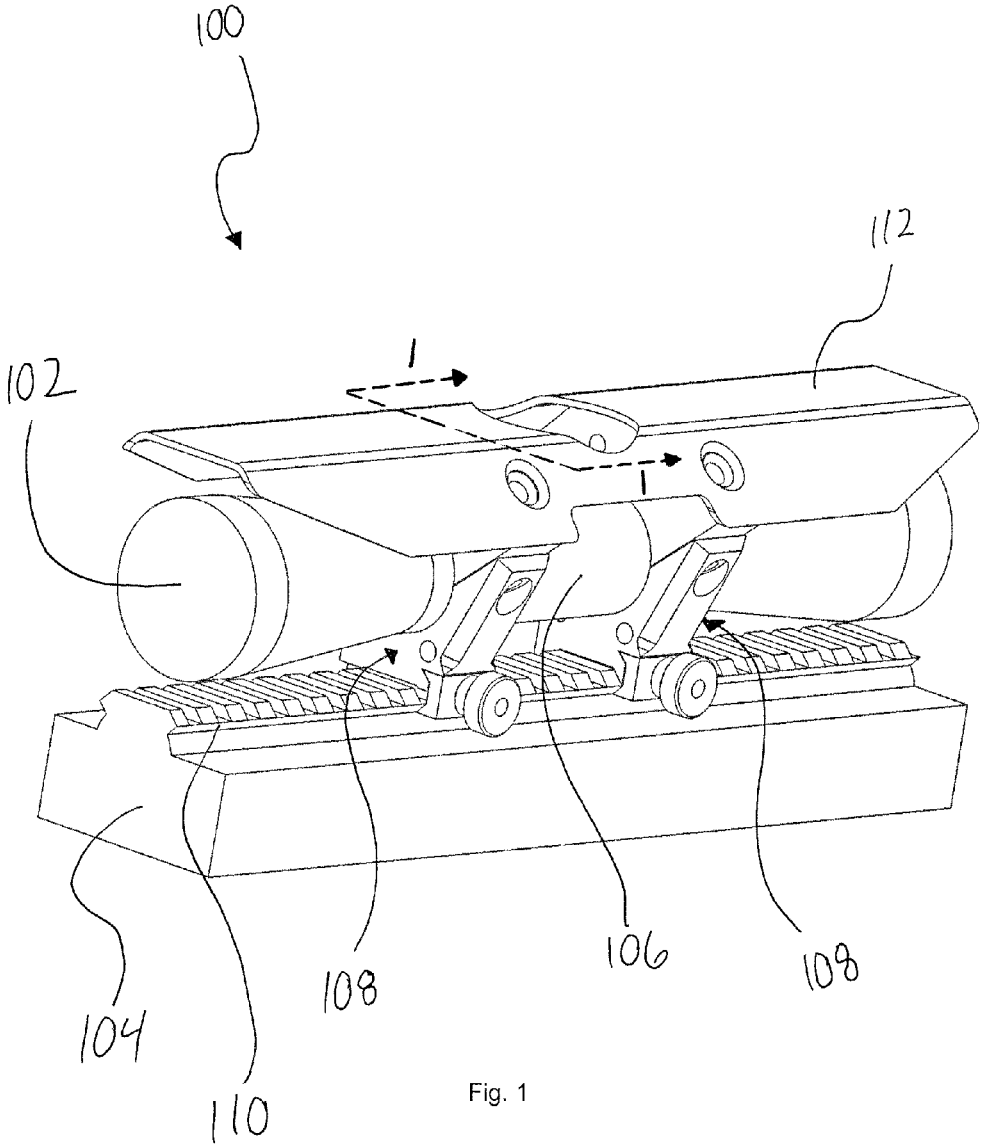
FIG. 1 is a perspective view of one illustrative embodiment of a scope mounting apparatus with a shield mounted to an exemplary rail and body.

Referring now to FIG. 1, a scope mounting apparatus 100 is shown coupling an illustrative optic 102 to a body 104. The body 104 may be any device that requires alignment. While the body 104 is not limited to being part of a device that expels a projectile, in one example the body 104 may be a portion of a cross-bow, rifle, handgun, shotgun or any other similar device. The optic 102 may be any type of optic or other device that requires alignment with the body 104. In one non-exclusive embodiment, the optic 102 may be a scope used to align the body with a target. Further, the optic 102 may be a laser site, dot site, variable scope, non-variable scope or any other type of optic 102 known by a person having skill in the relevant art. The optic 102 may have an optic coupler portion 106 that is sized to be coupled to the body 104 through one or more scope rings 108. Further, in one embodiment a Weaver or Picatinny rail 110 may be positioned along the body 104 to provide a surface to clamp the scope rings 108 to the body 104. While the Picatinny rail is shown and described herein, this disclosure considers any type of rail that allows the scope rings 108 to be coupled thereto. Further, another embodiment may have no rail at all. In the embodiment with no rail, the scope rings 108 may be coupled directly to the body 104 via one or more coupler such as bolts, screws, or the like. In the embodiment shown in FIG. 1, a protective shield 112 is shown coupled to the scope rings 108 as will be described in more detail below.

Figure 2:
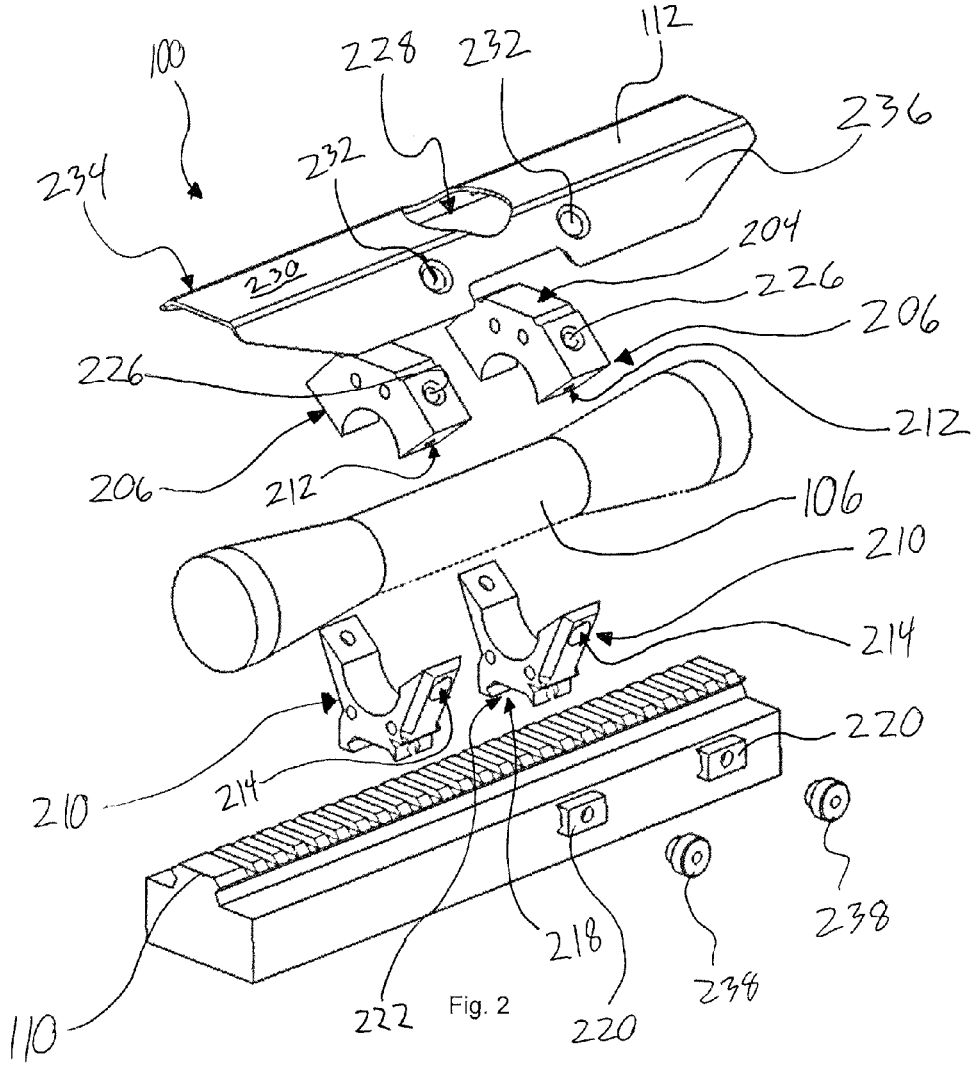
FIG. 2 is an exploded view of the embodiment shown in FIG. 1.

Referring now to FIG. 2, an exploded view of the scope mounting apparatus 100 is shown. Also shown in FIG. 2 is an extension 204 along a top member 206 of the scope ring 108. The scope ring 108 may be mounted to the Picatinny rail 110 and designed to couple the optic 102 to the body 104 as described above. In one nonexclusive embodiment, the optic 102 may be a scope. The scope ring 108 may couple the optic 102 to the body 104 in such a way that allows the optic 102 to align the body 104 with an object viewed through the optic 102. The extension 204 may provide a mounting surface that is sufficiently spaced from the optic 102 to accommodate the protective shield 112.

The top member 206 of the scope ring 108 may be removably coupled to a bottom member 210. In one non-exclusive embodiment, the top member 206 may be sized to position the scope shield 112 sufficiently away from the optic 102 to restrict the scope shield 112 from contacting the optic 102 when coupled thereto. Further, the top member 206 may define at least one threaded through hole 212 that corresponds with a smooth through hole 214 on the bottom member 210. In this embodiment, the top member 206 may be coupled to the bottom member 210 by placing a screw (not shown) through the smooth through hole 214 in the bottom member 210 and threading the screw into the threaded through hole 212 of the top member 206. Further, the top member 206 and the bottom member 210 can include more than one threaded through hole 212 and smooth through hole 214 that can couple the top member 206 to the bottom member 210. While screws and threaded through holes are described herein, this disclosure is not limited to any particular coupling method.

Figure 3:
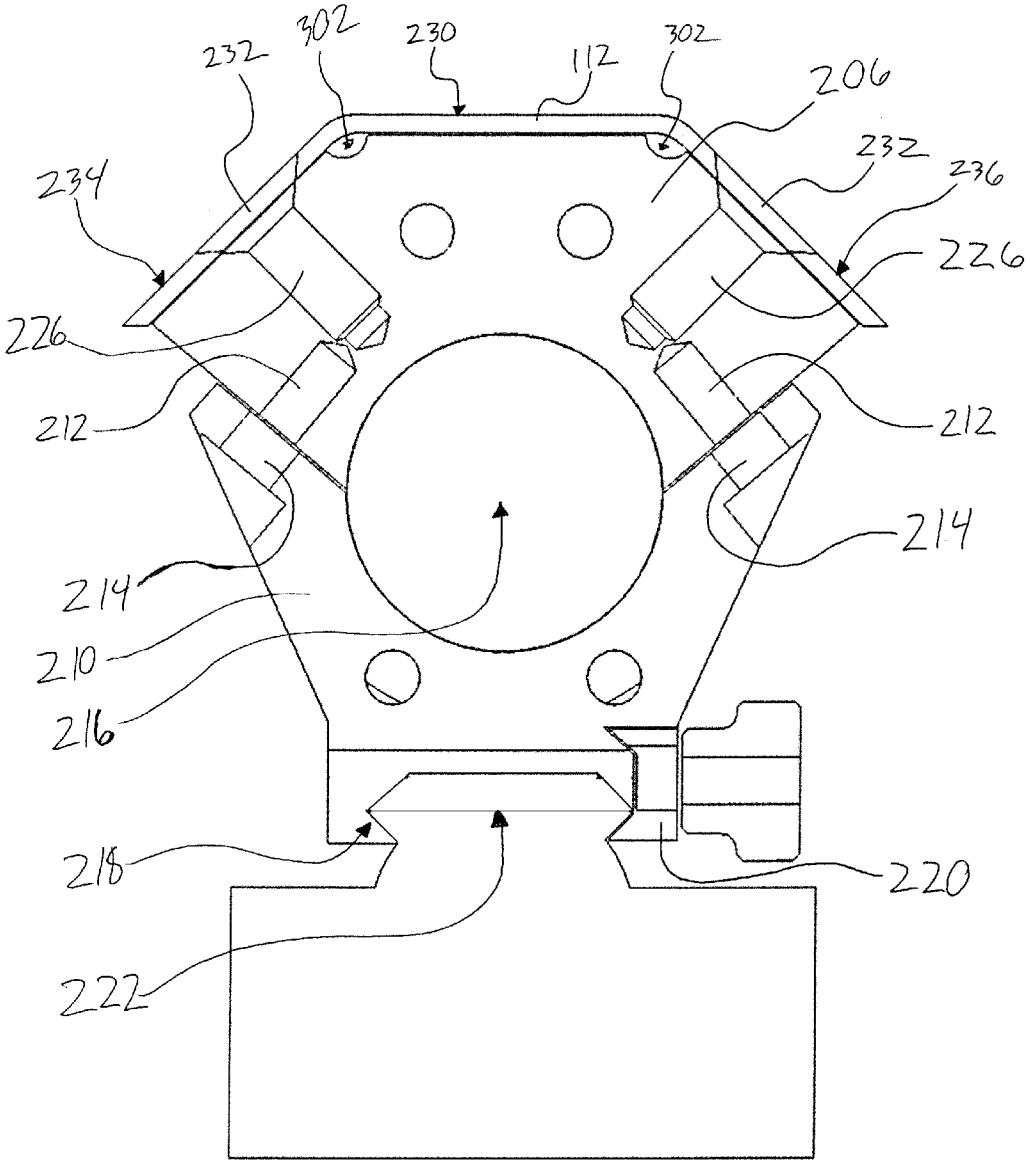
FIG. 3 is a cross-sectional view through a scope mount from the embodiment of FIG. 1 along a line 1-1.

When the top member 206 is coupled to the bottom member 210, an optic aperture 216 (see FIG. 3) may be defined therebetween. The optic aperture 216 may be specifically sized to receive the coupler portion 106 of the optic 102. In one non-exclusive embodiment, the optic aperture 216 may be substantially circular and have a 1" diameter. However, any other sized optic aperture 216 is also considered herein. The optic aperture 216 may also be sized to be slightly smaller than the coupler portion 106 of the optic 102 so that the optic 102 is substantially held in place by a clamping force between the top member 206 and the bottom member 210 when they are coupled to one another.

The scope ring 108 may also have a mounting base 218 along a lower part of the bottom member 210. The mounting base 218 may have a corresponding side member 220 that can be removably coupled thereto. The side member 220 may couple to a side of the mounting base 218 to define a retention cavity 222 between the mounting base 218 and the side member 220 when they are coupled to one another. In one nonexclusive embodiment, the retention cavity 222 may be defined to receive a portion of the Picatinny rail 110. In this embodiment, the scope ring 108 may slide along the Picatinny rail 110 to become disposed at a plurality of locations therealong. Once the scope ring 108 is at a desired location on the Picatinny rail 110, a thumb screw 238 and threaded member (not shown) may be used to compress the side member 220 to the mounting base 218 and thereby clamp the scope ring 108 to the Picatinny rail 110.

While the described mounting system involves the Picatinny rail 110, the skilled artisan understands that many mounting methods could be used. For example, the mounting base 218 could be directly coupled to the body 104 through screws, adhesives, welds, or any other similar articles, parts, and methods and this disclosure should not be limited to any one article, part or method.

The protective shield 112 may be coupled to the top member 206 and extend longitudinally along the length of the optic 102 to create a barrier that substantially protects at least portion of the optic 102. In one embodiment, the shield 112 protects a major portion of the optic 102 to substantially prevent or to reduce damage to the optic resulting from an impact. The protective shield 112 may couple to the top member 206 through many different coupling methods. In one embodiment, the top member 206 may define a threaded section 226 that allows a threaded coupler (not shown) to couple the protective shield 112 to the top member 206. More specifically, the protective shield 112 may have one or more shield through holes 232 defined through a portion of the protective shield 112 that may become aligned with the threaded section 226. When the threaded section 226 of the top member 206 is aligned with the shield through hole 232, the threaded coupler may become positioned therethrough to couple the protective shield 112 to the top member 206. In a different embodiment, the protective shield 112 may be coupled to the top member 206 with adhesives, welds, or any other common coupling method.

The protective shield 112 may also define an adjustment aperture 228 (See FIG. 2) that allows a user to adjust and calibrate the optic 102. In one embodiment, the adjustment aperture 228 is centered along a top portion 230 of the protective shield 112. A person having skill in the art understands that optics 102 frequently have adjustable components that require access. Accordingly, the adjustment aperture 228 may be positioned along the protective shield 112 at a portion of the protective shield 112 that would cover the adjustable component of the optic 102. Further, if the optic 102 does not contain an adjustable component, the protective shield 112 may not have the adjustment aperture 228.

In yet another embodiment, the adjustment aperture 228 may also have a cap (not shown) that can substantially cover the adjustment aperture 228 when not being used. The cap may be sized to be frictionally coupled to the adjustment aperture 228. In a different embodiment, the cap may be threadably coupled to the protective shield 112. In this embodiment, the cap may be pivoted to an opened position to allow access through the adjustment aperture 228 to the optic 102 and the cap may also be pivoted to a closed position where the cap substantially covers the adjustment aperture 228. There are many ways a cap can be utilized to cover an aperture and this disclosure is not limited specifically to the embodiments described herein.

The protective shield 112 may be made of a rigid material that can transfer forces from the protective shield 112 to the body 104 without substantially affecting the position or calibration of the optic 102. Accordingly, the protective shield 112 can guard the optic 102 from external forces by absorbing the impact of the external forces and transferring them to the body 104 through the scope ring 108. Further, the top portion 230 of the protective shield may be planar and coupled between a planar first side portion 234 and a planar second side portion 236. The first and second side portions 234, 236 may be angularly offset from the top portion 230 to increase the rigidity of the protective shield 112. In another embodiment the protective shield 112 may have a substantially arc-shaped cross-section and not define any planar portions.

While only one scope ring 108 has been described in detail herein, the person having skill in the art understands that these teachings apply to any number of scope rings 108. More specifically, this disclosure applies to an optic 102 being coupled to the body 104 using two scope rings 108. Each scope ring 108 could be coupled to the same optic 102 and protective shield 112 and incorporate the teachings of this disclosure. Accordingly, this disclosure should not be limited to any particular number of scope rings 108 utillized for mounting an optic 102.

Also considered herein is a method for manufacturing a scope mounting apparatus 100 described above. More specifically, the manufacturing method may include forming the bottom member 210 from a material such as steel, aluminum, stainless steel, or any other metal, metal alloy, plastic, or polymer sufficiently rigid to properly mount the optic 102 to the body 104. The forming may be executed by machining the required features into a blank piece of material or by molding the bottom member 210 utilizing a mold that defines the required features. More specifically, the mounting base 218 and a portion of the aperture 216 may be machined or molded into the bottom member 210 as described above. The top member 206 may be similarly machined or molded to define the features described above along with a portion of the aperture 216. The machining or molding process may also include boring the threaded section 226 into the top member 206. Boring the threaded section 226 into the top member 206 may include drilling an initial partial through hole of the proper diameter and then utilizing a tap to cut threads into the walls of the partial through hole as is known in the art.

The manufacturing method may include forming the protective shield 112 from a material such as steel, aluminum, plastic, or the like and boring the shield through hole 232 through the protective shield 112. The shield through hole 232 and the threaded section 226 may be sized to receive a fastener (not shown) that may couple the protective shield 112 to the top member 206. In one non-exclusive example, the fastener may be a screw with a threaded base and an expanded head, where the expanded head is larger than the shield through hole 232.

In another aspect of the method of manufacturing, the protective shield 112 may be formed by welding the top portion 230 to the first and second side portions 234, 236. More specifically, the first side portion 234 may be welded to the top portion 230 along a first edge while the second side portion 236 may be welded to the top portion along a second edge on the opposite side of the top portion 230 from the first edge. Further, each of the top portion 230, the first side portion 234, and the second side portion 236 may be angularly offset from one another.

In another embodiment, the first and second side portion 234, 236 may be integrally formed with the top portion 230. In this embodiment, the planar disposition of the respective portions 230, 234, 236 of the protective shield 112 may be formed by bending one singular piece of material into the proper cross-section. Further, another embodiment may utilize a rolling technique to manufacture the protective shield 112 and this disclosure considers many different methods for manufacturing the protective shield 112.

In one embodiment of the present disclosure, one or more channels 302 may be formed in a portion of the upper member 206 that is positioned adjacent to a boundary where the top portion meets the respective first or second side portion 234, 236. The channel 302 may be sized to allow welds or any other protrusion along the joint to become positioned therein, allowing the respective portions 230, 234, 236 to become adjacent to the corresponding surface of the upper member 205. In another embodiment, the upper member 206 is formed by a single piece of metal bent to the appropriate configuration, is formed by casting, or by protrusion of a flowable material into a mold.

In another aspect of the present disclosure, the upper member 206 may have sufficient thickness to prevent the protective shield 112 from contacting the optic 106 when coupled thereto. Further, the upper member 206 may have a cross-section that corresponds with the cross section of the protective shield 112. As described in more detail above, the protective shield 112 may have planar portions 230, 234, 236 offset from one another. In one embodiment, the upper member 206 may define planar surfaces that are parallel to the respective planar portions of the top portion 230, the first side portion 234, and the second side portion 236. In the embodiment where the protective shield 112 has an arc-shaped cross-section, the top member 206 may have a corresponding arc-shaped cross section that allows the protective shield 112 to be coupled along the top surface of the top member 206.

In another aspect of the present disclosure, the adjustment aperture 228 may be formed by boring a hole through a portion of the protective shield 112 with a drill or other similar boring tool. The location of the adjustment aperture 228 may be selected based on the type of optic 102 that the protective shield 112 will surround. More specifically, different optics 102 may require the adjustment aperture 228 to be positioned at different locations along the protective shield 112. Accordingly, during the manufacturing of the protective shield 112, the particular type of optic 102 for which the shield is meant to be coupled too may be considered in selecting where to bore the hole for the adjustment aperture 228.

The side members 220 may also be machined or otherwise formed as described above for the upper and lower members 206, 210. Further, the side members 220 and the mounting base 218 may have a coaxial through-hole. The coaxial through-hole may be sized to receive a bolt. The bolt may have a head that contacts a portion of mounting base 218 and a shaft that extends through the coaxial through-hole past the side member 220. Further, the thumb screw 238 may be threadably coupled to the shaft to provide a clamping force between the mounting base 218 and the side member 220. Accordingly, the clamping force can be adjusted by altering the thumb screw 238 and thereby allow the respective scope ring 108 to slide along, or be removed from, the rail 110.

While an exemplary embodiment incorporating the principles of the present application has been disclosed hereinabove, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations).

What is claimed is:

1. A mounting assembly for mounting an optic to a body, comprising:

a first and second bottom member defining a first and second mounting base, the first and second bottom members spaced from one another;

a first and second top member releasably coupled to the respective first and second bottom member to define an optic aperture therebetween;

a protective shield coupled to and extending between each of the first and second top member;

wherein, the protective shield is coupled directly to each of the first and second top member and the first and second top member is coupled to the body through the respective first and second bottom member, a threaded section defined in each of the first and second top member;

a shield through hole defined in the protective shield; and a threaded fastener positioned through the shield through hole and coupling the protective shield to at least one of the first and second top member.

2. The mounting assembly of claim 1, further comprising:

a first threaded through hole defined in each of the first and second top member; and a first smooth through hole defined in each of the first and second bottom member;

wherein a first fastener is positioned through the first smooth through hole and threadably coupled to the first threaded through hole to removably couple the corresponding first and second top member to the respective first and second bottom member.

3. The mounting assembly of claim 2, further comprising:

a second threaded through hole defined in the first and second top member; and a second smooth through hole defined in the first and second bottom member;

wherein a second fastener is positioned through the second smooth through hole and threadably coupled to the second threaded through hole to removably couple the corresponding first and second top member to the respective first and second bottom member.

4. The mounting assembly of claim 3, wherein the first and second fasteners threadably couple the first and second top member to the respective first and second bottom member to provide a clamping force on a portion of the optic positioned through the aperture.

5. The mounting assembly of claim 1, further comprising:

a first and second side member selectively coupled to the respective first and second mounting base;

wherein, the first and second side member and the first and second mounting base define a retention cavity sized to correspond with a rail;

further wherein, the first and second side member is coupled to the first and second mounting base to provide a clamping force on the rail when positioned in the retention cavity.

6. The mounting assembly of claim 1, further comprising an adjustment aperture defined through the protective shield and positioned to correspond with an adjustable component of the optic.

7. An optic mounting system for mounting an optic to a body, comprising:

a first scope ring comprising:

a first bottom member defining a first mounting base;

a first top member releasably coupled to the first bottom member to define a first optic aperture therebetween;

a second scope ring comprising:

a second bottom member defining a second mounting base;

a second top member releasably coupled to the second bottom member to define a second optic aperture therebetween;

a protective shield coupled to the first top member and the second top member;

wherein, the protective shield substantially aligns the first optic aperture with the second optic aperture when the protective shield is coupled to the first and second top members;

a threaded section defined in each of the first and second top member;

a shield through hole defined in the protective shield; and a threaded fastener positioned through the shield through hole and coupling the protective shield to at least one of the first and second top member.

8. The optic mounting system of claim 7, further wherein the protective shield is defined by a substantially planar top portion positioned between a first and second substantially planar side portions.

9. The optic mounting system of claim 7, wherein the first and second bottom member couple both the optic and the protective shield to the body.

10. The optic mounting system of claim 7, wherein the first and second bottom members defines a retention cavity sized to slidably couple to a rail of the body.

11. The optic mounting system of claim 10, wherein the first and second bottom members are clamped to the rail with a first and second side member.

12. The optic mounting system of claim 7, further comprising an adjustment aperture defined through the protective shield at a location between the first and second top members.

13. The optic mounting system of claim 7, wherein the body is a portion of a rifle, crossbow, or handgun.

14. A method for manufacturing a scope mounting assembly, comprising:

forming a bottom member from a material, the bottom member defining a mounting base and a portion of an aperture;

forming a top member from a material, the top member defining a portion of the aperture;

boring a threaded section into the top member; and forming a protective shield from a material and boring a shield through hole through the protective shield;

wherein, the shield through hole and the threaded section are sized to receive a fastener that couples the protective shield to the top member.

15. The method of manufacturing a scope mounting assembly of claim 14, wherein the bottom member and the top member are formed by removing material from a respective first and second block of material.

16. The method of manufacturing a scope mounting assembly of claim 14, wherein the fastener is a screw with a threaded base and an expanded head, the expanded head being larger than the shield through hole.

17. The method of manufacturing a scope mounting assembly of claim 14, wherein the protective shield is formed to define a top plane, a first side plane, and a second side plane.

18. The method of manufacturing a scope mounting assembly of claim 14, wherein an adjustment aperture is formed through a portion of the protective shield.

19. The method of manufacturing a scope mounting assembly of claim 14, further comprising forming a side member and coupling the side member to the mounting base.

* * * * *